US007441668B2

(12) United States Patent
O'Malley

(10) Patent No.: US 7,441,668 B2
(45) Date of Patent: Oct. 28, 2008

(54) BALANCING BOTTLE HOLDER

(76) Inventor: Michael T. O'Malley, 1135 Gunnison Ave, Grand Junction, CO (US) 81501

( * ) Notice: Subject to any disclaimer, the term of this patent is extended or adjusted under 35 U.S.C. 154(b) by 474 days.

(21) Appl. No.: 11/232,684

(22) Filed: Sep. 22, 2005

(65) Prior Publication Data

US 2007/0062893 A1 Mar. 22, 2007

(51) Int. Cl.
*A47B 73/00* (2006.01)

(52) U.S. Cl. ..... 211/74

(58) Field of Classification Search ..... 211/74, 211/13.1; D7/619.1, 619.2; 248/146; 206/139; 220/99

See application file for complete search history.

(56) References Cited

U.S. PATENT DOCUMENTS 4,496,124 A * 1/1985 Cole ..... 248/146
4,795,038 A * 1/1989 Johnson ..... 211/74
D329,781 S * 9/1992 Ito ..... D7/619.1
5,180,066 A * 1/1993 McArdle ..... 211/74
5,197,612 A * 3/1993 Thomson ..... 211/74
5,624,043 A 4/1997 Baptista
D422,458 S * 4/2000 Tate ..... D7/619.1
D432,872 S * 10/2000 Moore ..... D7/619.2
D433,632 S * 11/2000 Bender ..... D9/739
D456,220 S * 4/2002 Loiacono ..... D7/619.1
D488,358 S * 4/2004 Cook ..... D7/619.1
D527,586 S * 9/2006 Bacchus ..... D7/619.2
D530,039 S 10/2006 Blackman
7,195,125 B1 * 3/2007 Wolseth ..... 211/74

FOREIGN PATENT DOCUMENTS

FR 2470158 A1 5/1981
GB 2 229 352 9/1990

* cited by examiner

*Primary Examiner*—Sarah Purol
(74) *Attorney, Agent, or Firm*—Leyendecker & Lemire, LLC; Kurt Leyendecker

(57) ABSTRACT

A bottle holder that is unbalanced when its base surface is placed on a horizontal surface but is balanced on the base surface when a neck of a bottle is received and position in an opening provided in the holder. The opening which extends from a front side to a rear side is generally oval in shape on the front side but only partially oval on the back side wherein the top portion of the partial oval comprises a horizontal linear edge. This edge helps stabilize the bottle's neck within the opening making it easier for a user to locate the bottle's neck at the proper location in the opening to facilitate the balanced combination.

20 Claims, 6 Drawing Sheets

BALANCING BOTTLE HOLDER

FIELD OF THE INVENTION

This invention pertains to beverage bottle holders.

BACKGROUND

Balancing wine bottle holders of the general type of the present invention are known having been first taught in U.S. Pat. No. 4,496,124, which issued in 1985, and having been illustrated in various design patents: D432,872; D433,632; D456,220; D350,039; and D488,358. A typical prior art wine bottle holder is illustrated in prior art FIGS. 1-4. Most of these prior art holder including the illustrated holder 10 generally comprise (i) an elongated body 15 that extends upwardly at an acute angle 20 relative to a base surface 25 and (ii) an opening 30 provided in the body into which a neck of a wine bottle can be received. The area of the base surface 35 is generally small relative to the length of the body. The center of gravity of each of these holders is located horizontally to the left or right of the base surface, and accordingly, an empty holder topples over when one tries to stand the holder on its base on a substantially horizontal surface. However, when a neck of a bottle of wine is placed appropriately in the opening with the bottle extending in a horizontal direction opposite the direction in which the body is leaning, the center of gravity of the two combined is moved to be vertically aligned with the midpoint of the base. Accordingly, the combination is balanced and the holder remains upright supported only on its base surface with the bottle extending outwardly from the opening. For sake of clarity, the wine bottle is omitted in FIG. 1 but it is to be understood that the wine bottle would be necessary for the holder to maintain an upright stance as shown in FIG. 1.

The prior art teaches the balancing holder can be made of any suitable rigid material such as wood or plastic. Many of the prior art versions of the holder, such as those illustrated in FIGS. 1-4, are generally rectangular in cross section and having a rectangular base surface 35, a top surface 40 and front and rear face surfaces 45 & 50 with parallelogram shaped side surfaces 55 & 60. Although as evidenced by the referenced prior art, other designs are possible as well.

The opening 30 is typically of a diameter suitable for the neck of most wine bottles to be received therein and therethrough allowing for reasonable variation as is typical with wine bottles containing wines from different vineyards. In all prior art references, the opening is substantially annular. In some prior art holders, the opening 30 extends inwardly perpendicularly with the front and rear face surfaces 45 & 50 of the body 15 and is substantially circular in shape on either of the front and rear face surfaces. In yet other variations, such as illustrated in the prior art figures, the angle that the opening extends inwardly from the front or rear face surfaces is parallel to base surface 35 thereby forming an oval shape on the front and rear face surfaces. In yet other variations of the prior art holders, the opening may extending through the body at angles intermediate of perpendicular to the front face and parallel to the base surface. However, in all prior art holders wherein the opening extends all the way through the body, the shape of the opening on the front face surface 45 is substantially the same as the shape of the opening formed on the rear face surface 50.

While these bottle holders are effective in supporting many designs of bottles, in many instances it can be difficult for the user of a prior art holder to find the proper location of the bottle in the opening to create a balanced combination. Furthermore, there are some bottle designs that will not hold the bottle in the balanced position as the slope of the bottle coupled with the arcuate sections of the opening 30 cause the bottle to slide outwardly of the balance location(s), and accordingly, make the combination unstable and unable to be balanced.

DETAILED DESCRIPTION

Figure 1:
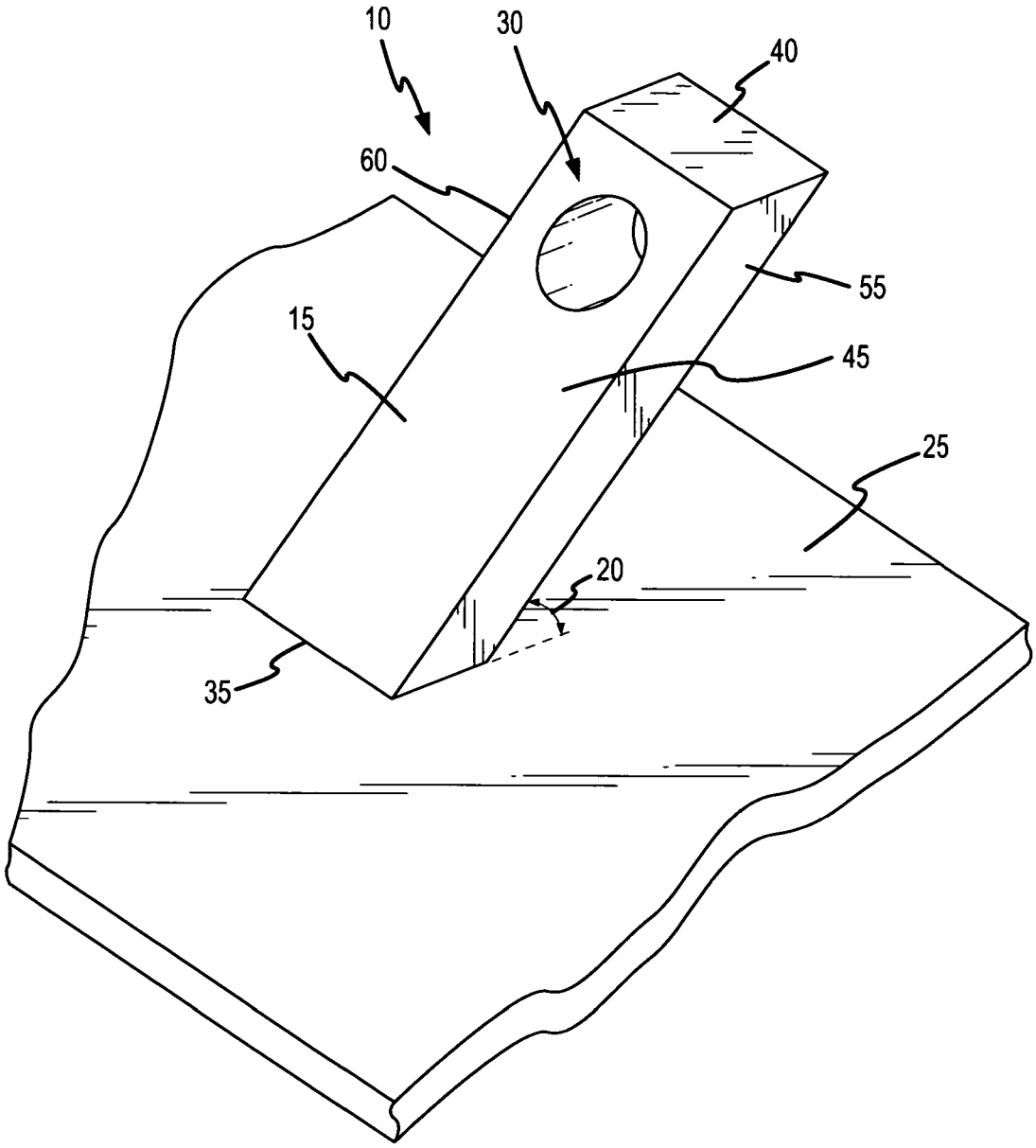
FIG.1 (PRIOR ART)
FIG. 1 is an isometric view of a prior art balancing wine bottle holder.
Figure 2:
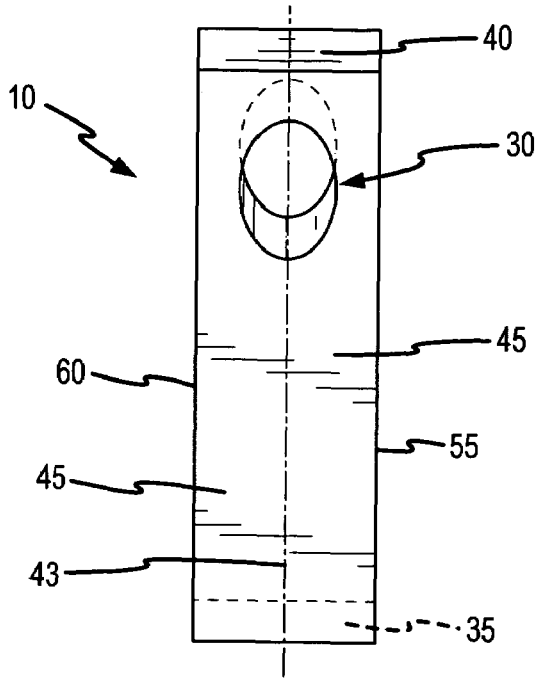
FIG.2 (PRIOR ART)
FIG. 2 is a front view of a prior art balancing wine bottle holder.
Figure 3:
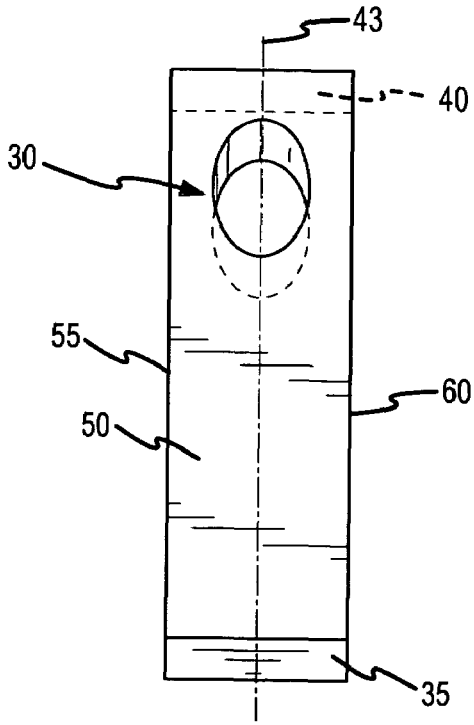
FIG.3 (PRIOR ART)
FIG. 3 is a rear view of a prior art balancing wine bottle holder.
Figure 4:
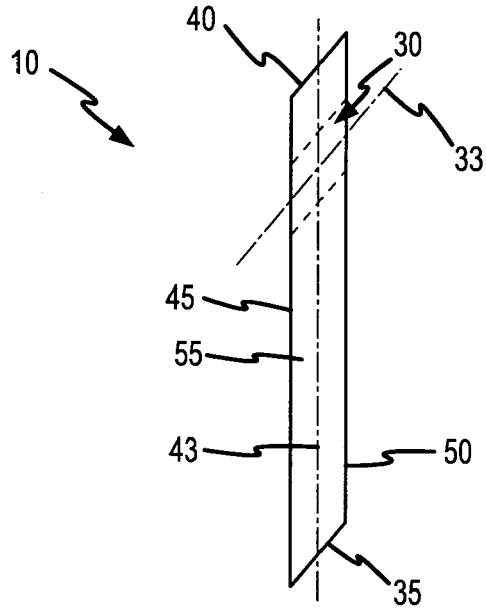
FIG.4 (PRIOR ART)
FIG. 4 is a side view of a prior art balancing wine bottle holder.

According to embodiments, the present invention comprises a bottle holder that is unstable when stood on a base surface alone but can be made to balance on the base surface when combined with a bottle that is typically at least partially full. Each embodiment bottle holder includes an ovalized opening that extends through a body of the holder to receive a neck of a wine bottle or other bottle therein. The opening is distinguished over openings in prior art balancing bottle holders in that the ovalized opening only extends partially through the rear surface of the body with the top portion of the opening on the rear surface is a substantially horizontally linear pointed edge.

Advantageously, the linear pointed edge helps hold an associated bottle in place in the holder hindering it from sliding outwardly of the opening and causing the combination of the holder and the bottle to become unbalanced. In prior art holders wherein the annular opening extends all the way through the body from the front surface through the back surface, the curved top portion of the opening on the rear surface is unable to adequately prevent certain types of bottles, such as wine bottles with tapered necks wherein the bottle interfaces with the curved top portion, from sliding outwardly and causing the combination to become unbalanced. Further, the large area or region of contact between a bottle neck and the top portion of the opening of prior art holders proximate the rear surface has a tendency to cause some slippage and movement of a many other types of wine bottles. This makes it more difficult for a user to establish an initial balanced condition between the holder and the associated bottle. Conversely, since the top portion of a bottle neck rests on the pointed linear edge of the top portion an embodiment of the present invention, the bottle is less likely to slide when released allowing a user to more precisely position the bottle during balancing, thereby making the balancing of the combination much easier and quicker.

Embodiments of the balancing bottle holder can be fabricated from any number of materials using any number of methods. Further, the shape of the holders can vary substantially. In some embodiments, the holder comprises a single piece of wood wherein each side is orthogonal to each other side and at least one end is cut to form an acute angle with the adjacent front and rear sides (surfaces). The opening is drilled into the piece using a round drill bit wherein the axis of rotation of the bit is orientated at an acute angle relative to the front side or a longitudinal axis of the holder. The drill bit is advanced through the piece at the acute angle towards the rear side until the bit breaks through the bottom portion of the back side and the bit has drilled through approximately 75% of the top portion of the opening. This forms the pointed linear top edge of the opening on the back surface of the piece. Generally, but not always, the acute angles formed between (i) the base surface and (ii) the axis of the opening each with the front side are the same.

Terminology

The term "or" as used in this specification and the appended claims is not meant to be exclusive rather the term is inclusive meaning "either or both".

References in the specification to "one embodiment", "an embodiment", "a preferred embodiment", "an alternative embodiment", "embodiments", "variations", "a variation" and similar phrases means that a particular feature, structure, or characteristic described in connection with the embodiment(s) or variation(s) is included in at least an embodiment or variation of the invention. The appearances of the phrase "in one embodiment" or "in one variation" in various places in the specification are not necessarily all referring to the same embodiment or variation.

Directional and/or relationary terms such as, but not limited to, left, right, nadir, apex, top, bottom, vertical, horizontal, back, vertical, horizontal, front and lateral are relative to each other and are dependent on the specific orientation of an applicable element or article, and are used accordingly to aid in the description of the various embodiments and are not necessarily intended to be construed as limiting.

As applicable, the terms "about" or "generally" as used herein unless otherwise indicated means a margin of +−20%. Also, as applicable, the term "substantially" as used herein unless otherwise indicated means a margin of +−10%. It is to be appreciated that not all uses of the above terms are quantifiable such that the referenced ranges can be applied.

The terms, "side" and "surface", such as in reference to a base side, a base surface, a front side, a front surface, a back side, a back surface are used generally interchangeably herein. Further, the terms, "side" and "surface" are used herein to refer to relative portions of an object. For instance, the phrase "front side" as applied to a cylindrical body traditionally is indefinite as a cylindrical body only has a single side surface (excepting the top and bottom sides). As used herein, however, phrases, such as "front side" and "back side" are intended to reference a "front portion" and "rear portion" of on the surface of a cylinder or other bodies not having distinct sides or surfaces.

One Embodiment Balancing Bottle Holder

FIGS. 5-9 provide various illustrative views of one embodiment of a balancing bottle holder. As illustrated, the holder comprises a unitary elongated generally rectangular body having parallel spaced-apart front and rear sides 145 & 150 (or surfaces) intersecting with parallel left and right sides 160 & 155 that are orthogonal to the front and rear sides. The body also includes bottom and top sides 135 & 140. The bottom side 135 is also referred to herein as the base side or base surface. The base surface is substantially planer with the base surface forming a acute angle with a longitudinal axis 143 of the body. The acute angle can vary among variation and embodiments but is typically, but not necessarily, between 30-60 degrees and more preferably about 45 degrees.

As shown, the top side 140 also forms an acute angle with the longitudinal axis of the body and is substantially parallel to the base surface 135. It is appreciated that the orientation and angle of the top side relative to the base surface and/or the longitudinal axis 143 may vary without significantly affecting the use or functionality of the holder.

The actual dimensions of the body can vary substantially but in one preferred variation, the body is about 10.5" long, 2.69" wide and 0.75" thick. Further, the body can be made of any number of materials including but not limited to wood, plastic, metal, or a composite. One variation is fabricated from wood using traditional wood working equipment, although the process of manufacturing the holder is not limited. For instance, a plastic version can be injection molded; and a metal version can be cast. Further, although the version illustrated is generally solid in cross section, other variations can include hollow portions as practical.

Figure 7:
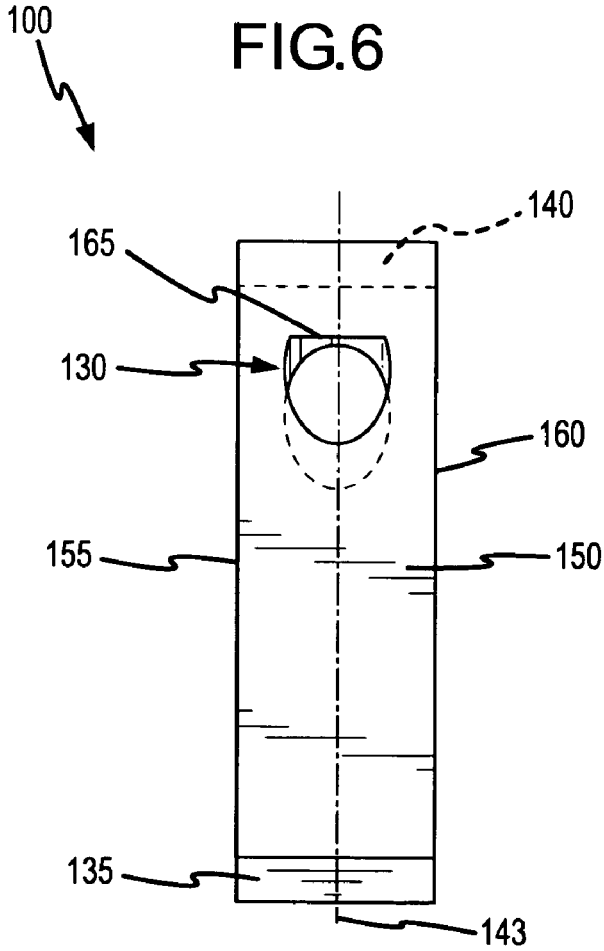
FIG. 7 is a rear view of a balancing bottle holder according to one embodiment of the present invention.
Figure 8:
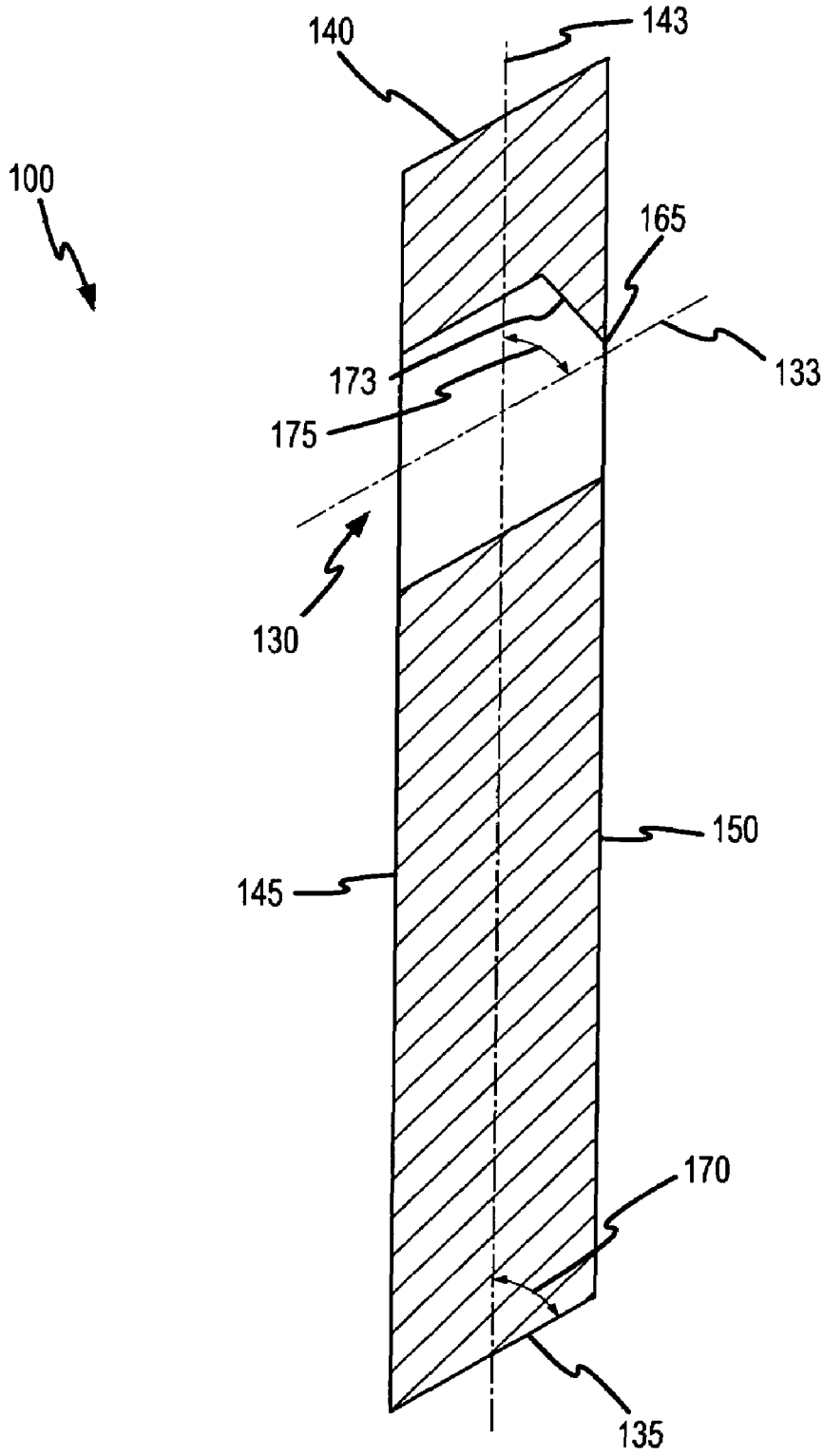
FIG. 8 is a cross sectional side view of a balancing bottle holder according to one embodiment of the present invention.
Figure 9:
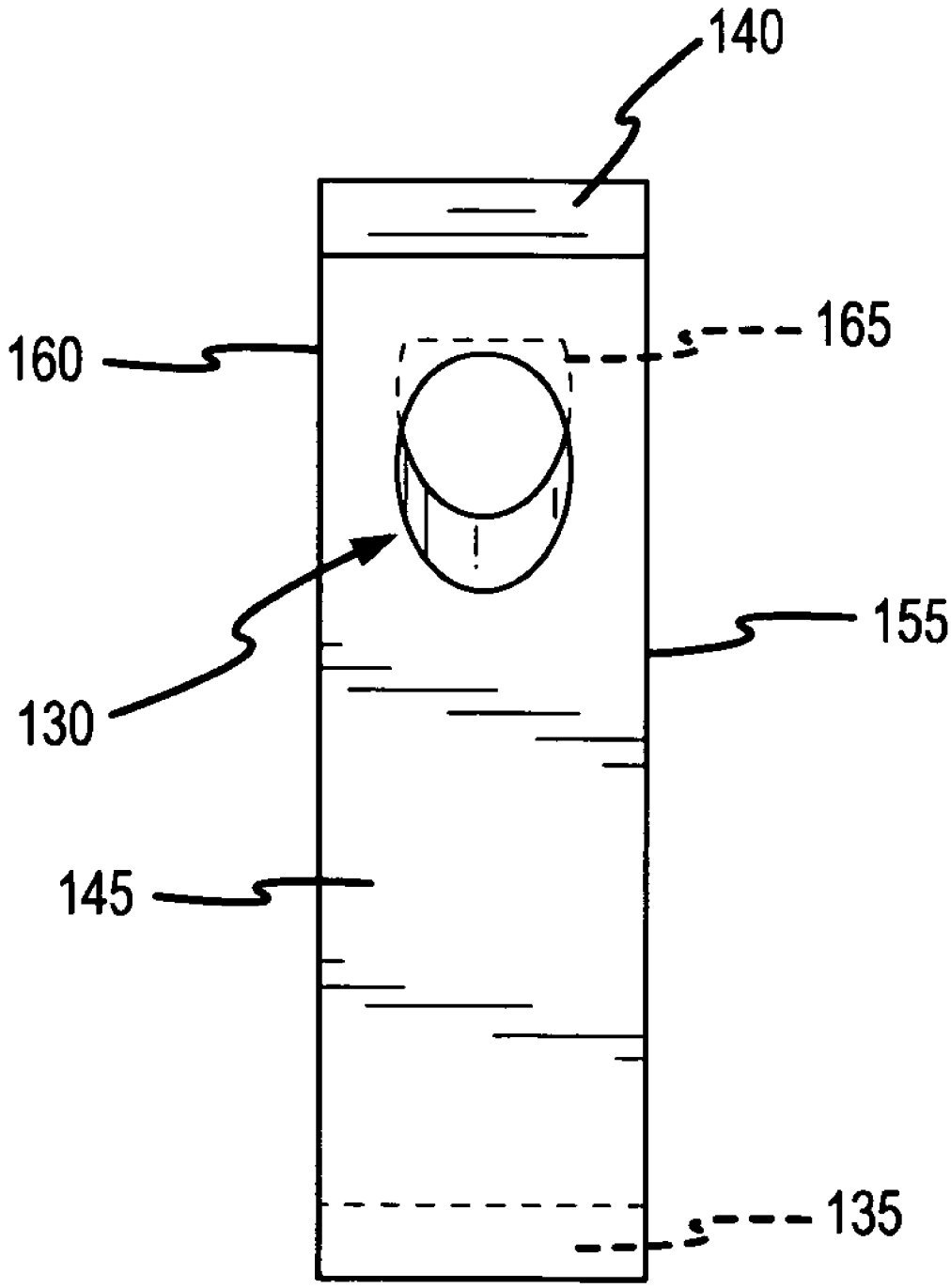
FIG. 9 is a front view of a balancing bottle holder according to one embodiment of the present invention.

Located generally above the midpoint of the body's longitudinal axis is an opening 130 that extends from the front side 145 through to the back side 150. When viewed from the front side, the opening has an oval shape, but the bore is actually substantially circular in cross section and extends inwardly of the front side and the longitudinal axis 143 at an acute angle 175 therewith. The circular bore (or ovalized bore when viewed normally from the front side) does not extend completely through the body from the front to rear sides. Rather, the opening extends through the back side 150 at a bottom portion of the opening but does not extend through the back side at a top portion of the opening. This is best illustrated in FIGS. 7 & 8, wherein a lip 173 extends downwardly from what would otherwise comprise a portion of the opening and forms a linear, substantially horizontal pointed edge 165 at the back side. Typically, the linear edge is located above the center axis of the opening's bore, but the actual location of the linear edge will vary depending on several factors including but not limited to The diameter(s) of the opening, and the diameters of the necks 205 of bottles intended for use with the holder proximate where the neck will be positioned in the opening.

In embodiments and variations comprised of wood (and in some instances embodiments made of other materials), the opening is formed by drilling into the body (or removing material by way of a mechanical machining process). When a drilling operation is utilized the rotational axis of the drill bit is orientated at an acute angle to the longitudinal axis 143. Typically, this acute angle is between 30-60 degrees and more preferably 45 degrees and is the same angle that the opening's bore axis forms with the longitudinal axis. The drill bit is advanced through the body until the bit breaks through the bottom portion of the opening on the back side 150 of the body. It is to be appreciated that in certain variations, the opening can be molded in place as an integral step in the formation of the body, such as when the holder is cast from a molten metal or liquid resin or is injection molded from a polymeric material.

Figure 5:
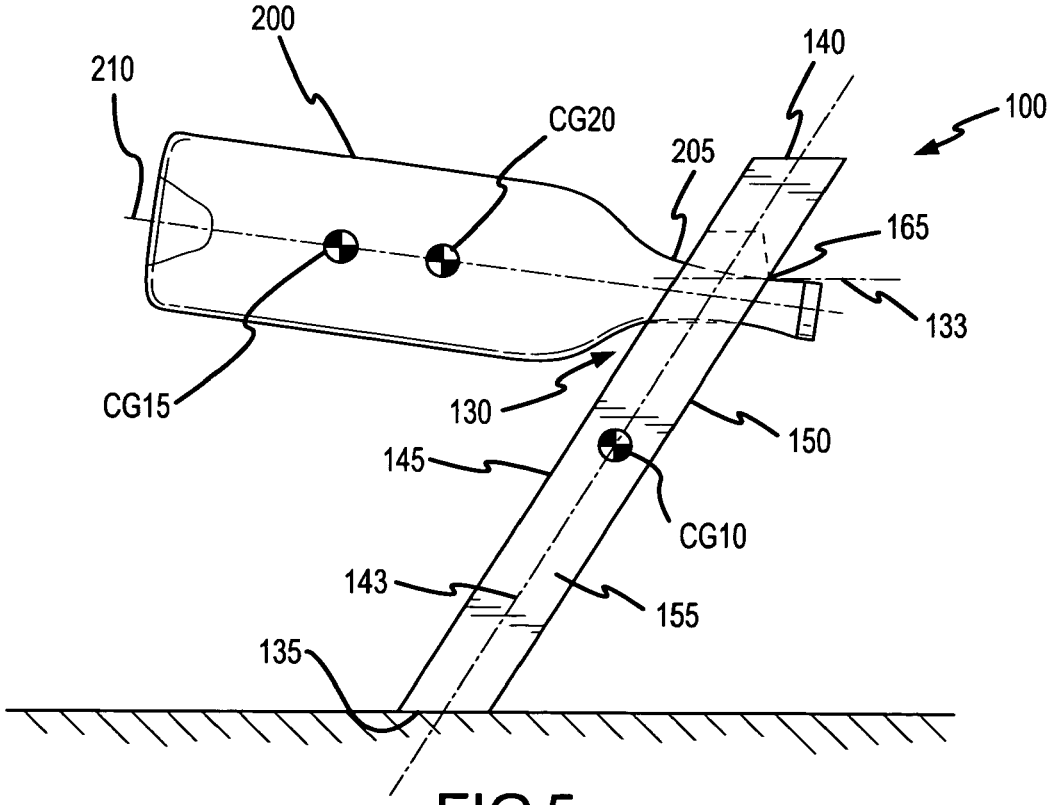
FIG. 5 is a side view of a combination of a balancing bottle holder and a bottle according to one embodiment of the present invention.
Figure 6:
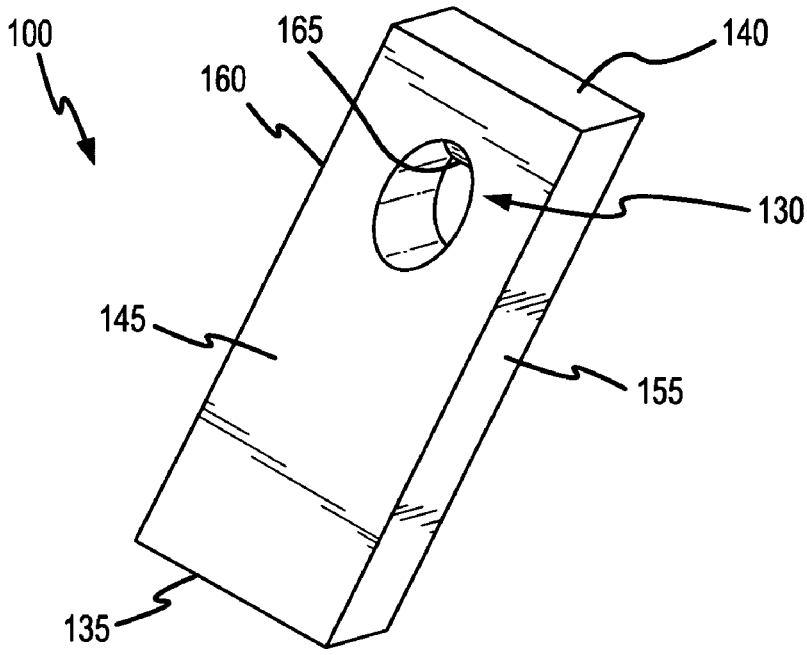
FIG. 6 is an isometric front view of a balancing bottle holder according to one embodiment of the present invention.

As illustrated, the acute angle 175 of the opening bore is substantially the same as the acute angle 170 that the base surface 135 forms relative to the longitudinal axis. However, in other variations these acute angles need not be similar. Generally speaking, although not absolutely, it is desirable that the acute angle 175 of the opening axis 133 be parallel to or greater than the acute angle of the base surface 135 so that the center axis 210 of a bottle 200 placed in the opening will not have a downwardly slant away from the front side 145 that could encourage the bottle to slide out of the opening and eliminate a balanced condition between the bottle and the holder. The bottle 200 as shown in FIG. 5 has an upwardly slant away from the holder 100. Of course, the angle of the bottle center axis forms relative to horizontal and the holder will depend on the configuration of the opening including the location of the linear pointed edge 165 on the back side 150 of the body.

In one preferred embodiment designed primarily to hold and balance with wine bottles, the circular diameter of the opening is 1.1-1.5" and preferably 1.375" and forms a 45 degrees angle with the longitudinal axis. For a 1.375" diameter opening formed at a 45 degree angle, the width of the oval formed on the front side is 1.375" and the length is about 2". On the back side, wherein a partial oval is formed, the width is 1.375" and the length between the bottommost portion of the partial oval and the horizontal linear pointed edge will vary depending on how far the opening bore extends in the opening on its topside proximate the rear face. In the one preferred embodiment, the distance is about 1.2-1.3" with the linear pointed edge having a similar length.

Referring primarily to FIG. 5 the use of the bottle holder in conjunction with a bottle is described herein below. When embodiments of the holder 100 are placed on a horizontal surface, such as a table or counter, with its base surface 135 being the only area of contact with the horizontal surface (or any other surface for that matter), the holder's center of gravity, CG10, is located vertically above and horizontally to the right of the base surface. Accordingly, the holder is not stable alone in such a position and would fall over. However, when a user places a bottle 200 having a center of gravity, CG15, to the left of the holder's base surface into the opening 130, the combined center of gravity, CG20, of both the bottle and the holder is shifted leftwardly of the holder's center of gravity. By adjusting the exact position of the bottle's neck 205 in the opening the combined center of gravity can be positioned so that it is located directly vertically above the base surface 135 and preferably as close as possible to the left right center of the base surface. When in such a position, the combination is stable and balanced.

Finding the position(s) of the neck 205 in the opening 135 wherein the combination is stable can be difficult using prior art holders as the neck will slide slightly to the left or right when a user lets go of and ceases to support the bottle 200. Accordingly, even if the user has found a location wherein the combined center of gravity is properly located to balance the combination when he/she completely releases the bottle, it may slide slightly and move the combined CG enough that it is vertically to the left or right of the base surface 135 and cause the combination to be unstable. Further, with certain bottles with necks that are tapered in the region that it needs to interface with the opening, the user may not be able to get the bottle to stay put in the opening. The pointed linear edge 165 of embodiments of the present invention has been demonstrated to better secure and hold the necks of bottles of various configurations thereby preventing undesired movement of the bottle when released by the user. Accordingly, the proper location to achieve a balanced combination can be more easily achieved with the embodiments of the present invention.

Alternative Embodiments and Other Variations

The various preferred embodiments and variations thereof illustrated in the accompanying figures and/or described above are merely exemplary and are not meant to limit the scope of the invention. It is to be appreciated that numerous variations to the invention have been contemplated as would be obvious to one of ordinary skill in the art with the benefit of this disclosure. All variations of the invention that read upon the appended claims are intended and contemplated to be within the scope of the invention.

For instance, the bottle utilized in combination with the holder has primarily been described as being a wine bottle or a beverage bottle. It is appreciated that the bottle need not contain any particular type of product whether solid or liquid. For example, a suitable bottle could be filled with spices, pasta, flour, sugar or any other suitable type of dry goods instead of a beverage or other liquid.

I claim:

1. A bottle holder that is (i) unstable when a base surface is horizontally orientated and placed on a horizontal surface and (ii) stable when a bottle is positioned in an opening provided in the bottle holder and the base surface is horizontally orientated and placed on a horizontal surface, the bottle holder comprising:

an elongated body having a front side, a back side and the base surface at one end thereof, the base surface forming an acute first angle with a longitudinal axis of the elongated body; and the opening, the opening extending between the front and back sides, the opening having a top portion, a bottom portion, a left portion, a right portion and a generally annular interior side wall, an center axis of the opening forming an acute second angle with the longitudinal axis, the opening being forming a substantially oval shape on the front side and a partially oval shape on the back side wherein the top portion of the opening shape on the back side is substantially horizontally linear.

2. The bottle holder of claim 1, wherein the first and second angles are substantially similar.

3. The bottle holder of claim 1, wherein the first angle is between about 30-60 degrees.

4. The bottle holder of claim 1, wherein the second angle is between about 30-60 degrees.

5. The bottle holder of claim 1, wherein the front side and back side of the elongated body are substantially planar.

6. The bottle holder of claim 1, wherein the holder is comprised substantially of wood.

7. The bottle holder of claim 1 fabricated by (i) cutting the elongated body to form the base surface, and (ii) drilling the opening into the elongated body.

8. The bottle holder of claim 1, the base surface is substantially rectangular.

9. The bottle holder of claim 1, wherein a center of gravity of the holder when the base surface is placed against on a horizontal surface is located horizontally to the right or left of the base surface.

10. The bottle holder of claim 1, wherein a minor axis of the oval shape on the front side is between 1.1" and 1.5".

11. A combination of a bottle and bottle holder comprising:

a bottle having a top end, a bottom end and a necked portion proximate the top end; and a bottle holder having a body with front and rear surfaces, a base surface and an opening, the base surface being substantially horizontal and intersecting with the front and rear surfaces, an axis of the body extending upwardly from the base at a first acute angle to a plane of the base surface, the opening extending between the front and rear surfaces with an axis of the opening forming a second acute angle to the axis of the body and forming an oval shape on the front surface and a partially oval shape on the rear surface, a top edge of the partially oval shape being generally horizontal and linear;

wherein the neck portion of the bottle is received in the opening with the neck portion braced against the top edge and the center of gravity of the combination is located at a point vertically above the base surface.

12. The combination of claim 11, wherein first acute angle is between 30-60 degrees.

13. The combination of claim 12, wherein the first and second acute angles are similar.

14. The combination of claim 13, wherein the base surface is the sole support for the combination when the base is placed on a horizontal surface.

15. The combination of claim 11, wherein the axis of the opening and a plane of the base surface are substantially parallel.

16. A method of fabricating a balancing bottle holder:

forming a body having a longitudinal length greater than the body's width, the body including a planer base surface orientated at a first acute angle to a longitudinal axis of the body, the body including front and rear surfaces; and forming an annular opening extending wholly through the front surface and only partially through the rear surface with a portion of the opening on the rear surface being substantially linear, the opening having an center axis orientated at an acute angle relative to the longitudinal axis.

17. The method of claim 16, wherein said forming an annular opening further comprises drilling the opening with a circular drill bit through the front surface and only partially through the rear surface with the axis of rotation of the drill bit being the same as the center axis of the opening.

18. The method of claim 17, wherein the diameter of the drill bit is 1.1"-1.5".

19. The method of claim 18, wherein the length of the substantially linear portion being between 80%-100% the diameter of the drill bit.

20. The method of claim 18, wherein the drill bit has a diameter of 1.375".

* * * * *